US006915620B2

(12) United States Patent
Williams

(10) Patent No.: US 6,915,620 B2
(45) Date of Patent: Jul. 12, 2005

(54) SHRINK TUNNEL ASSEMBLY

(75) Inventor: Jerry L. Williams, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 10/143,605

(22) Filed: May 10, 2002

(65) Prior Publication Data

US 2003/0208990 A1 Nov. 13, 2003

(51) Int. Cl.[7] ..... B65B 53/02; F26B 7/00; F26B 17/02

(52) U.S. Cl. ..... 53/442; 53/557; 34/359; 34/376

(58) Field of Search ..... 53/442, 557; 34/359, 34/413, 443, 508, 519, 576, 108, 130, 132, 653

(56) References Cited

U.S. PATENT DOCUMENTS

| | | | | |
|---|---|---|---|---|
| 3,312,811 A | | 4/1967 | Shanklin | 219/388 |
| 3,591,767 A | | 6/1971 | Mudie | 219/354 |
| 3,808,702 A | | 5/1974 | Laessig | 34/218 |
| 5,009,057 A | | 4/1991 | Wilkinson | 53/439 |
| 5,062,217 A | | 11/1991 | Tolson | 34/22 |
| 5,299,406 A | * | 4/1994 | Laury | 53/397 |
| 5,590,509 A | * | 1/1997 | Esteves et al. | 53/432 |
| 5,899,048 A | * | 5/1999 | Havens et al. | 53/442 |
| 6,158,199 A | | 12/2000 | Emery, III et al. | 53/442 |

* cited by examiner

*Primary Examiner*—John Paradiso
(74) *Attorney, Agent, or Firm*—Eckert Seamans Cherin & Mellott; Glenn E. Klepac

(57) ABSTRACT

A shrink tunnel assembly for wrapping an article with polymeric shrink film includes a shrink tunnel having a heating zone, and conveyor means for carrying an article to the heating zone and away from it. While in the heating zone, polymeric shrink film covering an article avoids contacting any solid surface, thereby protecting the article from marring and destruction.

12 Claims, 2 Drawing Sheets

SHRINK TUNNEL ASSEMBLY

FIELD OF THE INVENTION

The present invention relates to the field of packaging products in heat shrinkable film, and more particularly to shrink tunnels for applying such film to product packages.

BACKGROUND OF THE INVENTION

A shrink tunnel is a device for supplying heated air to an enclosed chamber for the purpose of shrinking a polymeric film around a package for physical protection and enhanced appearance. Shrink tunnels in commercial use today generally include a mechanical conveyer for carrying packages through the chamber.

One weakness of prior art shrink wrap methods is that conveyor belts are generally made of a metal mesh or silicone rollers that become so hot that some heat sensitive packages are marred or destroyed. Also, the weight of the product package pressing against the shrink film will prevent the shrink film from shrinking evenly around the package. The portion of the product lying on the conveyor will hold the shrink film and its weight will prevent the film from shrinking as quickly and uniformly as in areas not affected by the conveyor.

Another disadvantage of existing shrink wrap tunnels is that they are built to handle a large variety of product sizes. Therefore, when running small packages the tunnel is operating with a large volume of unneeded hot air. This represents wasted energy.

A principal objective of the present invention is to provide a shrink tunnel assembly that avoids damaging or marring the appearance of film covered packages.

A related objective of the invention is to provide a shrink tunnel assembly that operates more efficiently by reducing the volume of wasted hot air. This reduces energy costs for the tunnel operation, associated costs for conditioning the operating environment and, in an embodiment having no moving parts, reduces noise pollution and maintenance.

Additional objectives and advantages of my invention will become apparent to persons skilled in the art from the following detailed description of a preferred embodiment.

SUMMARY OF THE INVENTION

In accordance with the present invention there is provided a shrink tunnel assembly for shrink wrapping articles with a polymeric shrink film. Some examples of the types of articles commercially wrapped in shrink film include pharmaceutical packages, gift-wrap, window shades, door molding, and food products. Polymeric films used for shrink-wrapping generally contain at least one polymer selected from polyvinyl chloride, polyethylene, and styrene-butadiene copolymers.

The shrink tunnel assembly of the invention includes a shrink tunnel including a heating zone, means for conveying heated air into the heating zone, a first conveyor means for conveying film covered articles to the heating zone, and a second conveyor means for carrying film covered articles away from the heating zone. The shrink tunnel preferably has an exterior wall, an interior wall spaced inwardly of the exterior wall, and insulating material adjacent the exterior wall.

The interior wall of the shrink tunnel defines a chamber having an inlet opening, an outlet opening spaced downstream from the inlet opening, and a heating zone between the inlet opening and the outlet opening. The heating zone includes an entrance side and an exit side spaced downstream from the entrance side. The interior wall preferably also includes a side opening for conveying heated air into the heating zone, thereby to heat the polymeric shrink film to an elevated temperature. The film is preferably heated to a temperature of about 121–177° C. (250–350° F.) in the heating zone.

The means for conveying heated air into the heating zone includes an electric or gas powered heater, and an electric blower or compressed air capable of blowing heated air into the heating zone at a velocity greater than 2000 feet per minute, preferably greater than 3000 feet per minute.

The first and second conveyor means preferably each include a conveyor belt mounted on pulleys, both powered by an electric motor. The conveyor belt may have either steel belting, rollers, or a polymeric upper surface for conveying articles. The nature of the article to be wrapped determines the type of conveyor to be used.

An important feature of the present invention is that in the heating zone, polymeric film covering the articles does not contact any solid surface. In the particularly preferred embodiment shown and described herein, this objective of the invention is accomplished by locating the first and second conveyor means outside the heating zone. In one embodiment, first conveyor is spaced from the second conveyor by a distance $d_1$, and articles heated in the heating zone each have a length $d_2$ that is greater than $d_1$. The articles thereby avoid dropping down into a gap between the conveyor belts.

In the shrink tunnel assembly of the invention, convection heating of the shrink film results in the film being brought up to an appropriate temperature before any substantial heating of the article takes place. Any heating of the merchandise that does occur results from heat conduction through the plastic film. Plastics like polyvinyl chloride, polyethylene, and styrene-butadiene copolymers used in shrink-wrapping are generally poor conductors of heat. Accordingly heating of the merchandise is minimized.

DETAILED DESCRIPTION OF PREFERRED EMBODIMENTS

Figure 1:
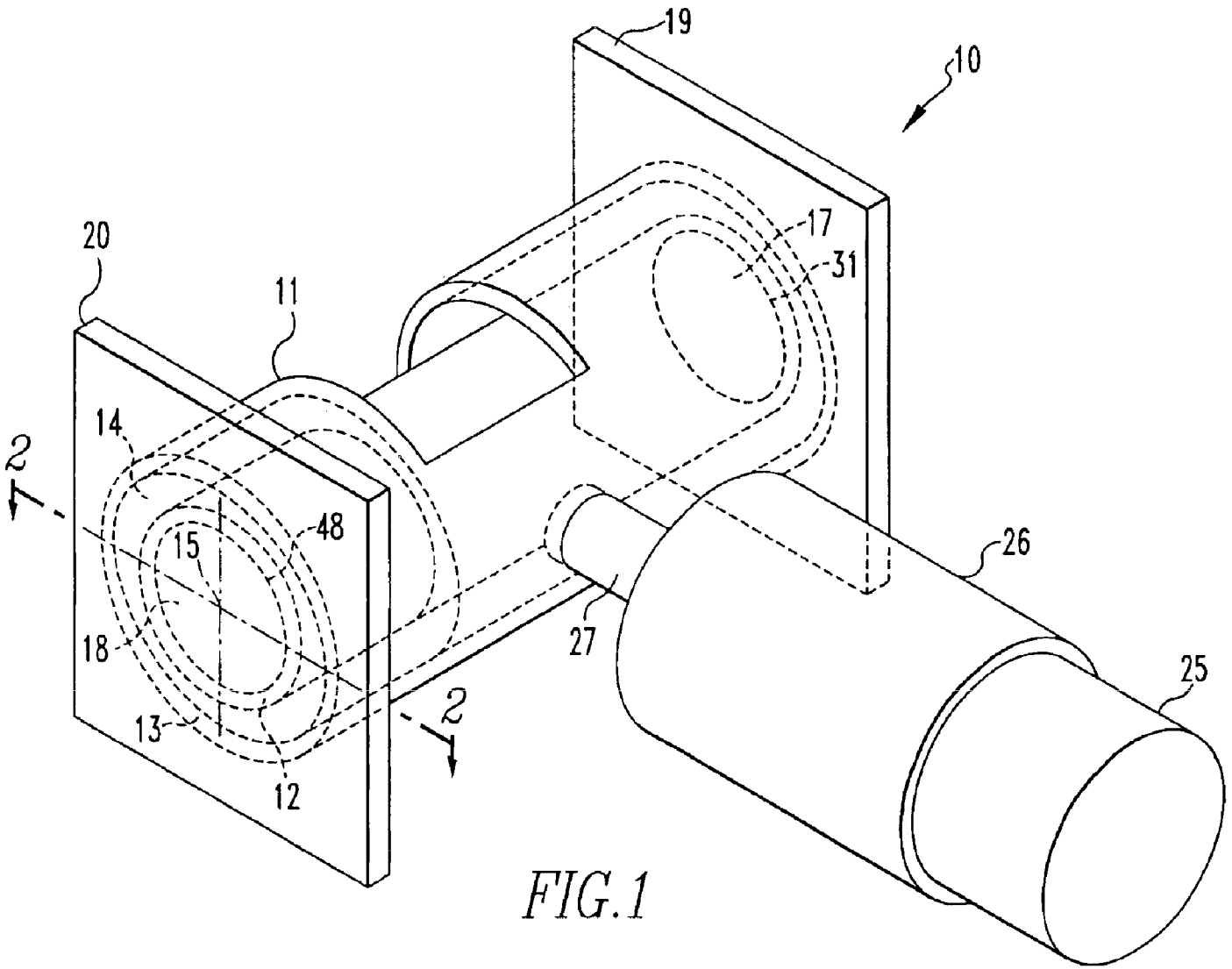
FIG. 1 is a perspective view of a preferred shrink tunnel assembly of the invention.

Referring to FIG. 1 there is shown a shrink tunnel assembly 10 of the present invention. The assembly 10 includes a shrink tunnel 11 having a metal interior wall 12, a metal exterior wall 13, and insulating material 14 outside the exterior wall 13. The interior wall 12 defines an elongated, generally cylindrical chamber 15 having an inlet opening 17 and an outlet opening 18 spaced downstream from the inlet opening 17. A first support stand 19 supports the tunnel 11 adjacent the inlet opening 17 and a second support stand 20 supports the tunnel 11 adjacent the outlet opening 18.

The assembly 10 also includes an electric heater 25 and compressed air or an electric fan 26 for blowing hot air into a side duct 27 extending through the tunnel exterior wall 13 and communicating with the chamber 15. A series of holes around the perimeter of the interior wall 12 allows heat to enter the chamber 15 and completely the article 30 to be heated. One suitable electric heater 25 for practice of the present invention is a 36 kw heater sold under the trademark "Sureheat 36,000" by Osram Sylvania. The electric fan 26 or compressed air is capable of blowing heated air into the chamber 15 at a velocity of at least 3000 fpm.

Figure 2:
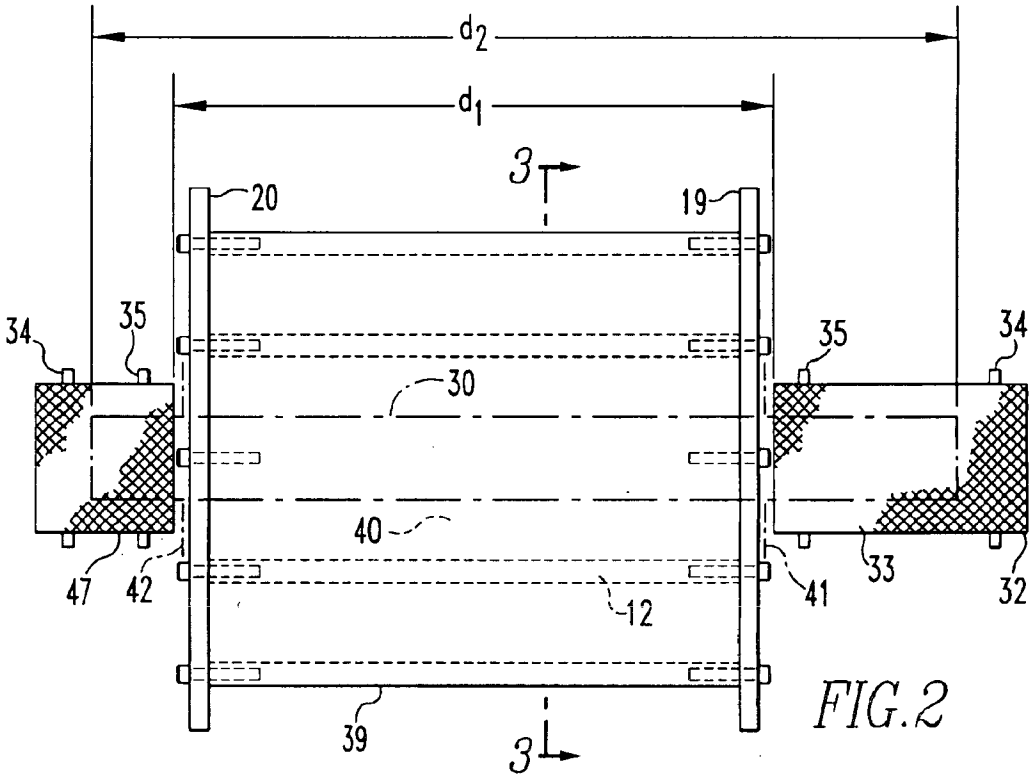
FIG. 2 is a cross-sectional view taken along the lines 2—2 of FIG. 1.
Figure 3:
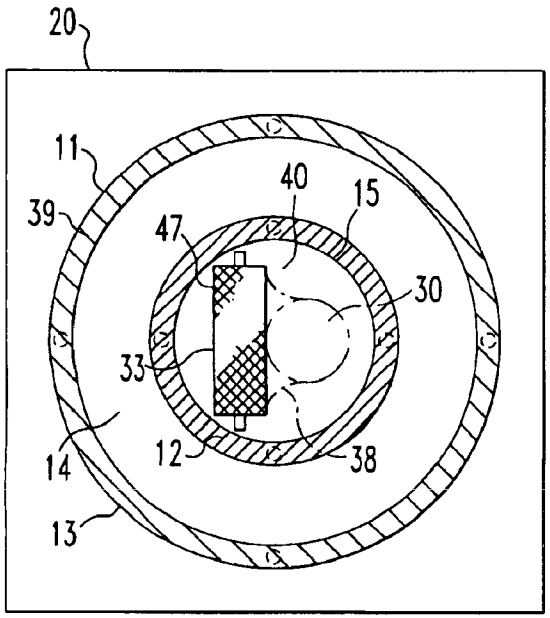
FIG. 3 is a cross-sectional view taken along the lines 3—3 of FIG. 2.

Referring now to FIGS. 2 and 3, articles 30 are delivered through an inlet opening 31 of the shrink tunnel 11 by a first conveyor or conveyor means 32 having a steel mesh belt 33 rotating around spindles 34, 35. An outside spindle 34 is rotated by an electric motor (not shown) and the belt 33 rotates passively around the inside spindle 35. The articles 30 are covered by a shrink film 38 having a thickness of about 0.5 to 3 mils. A polyvinyl chloride (PVC) shrink film is particularly preferred but other plastic films will work.

Articles 30 are carried on the first conveyor 32 to a heating zone 40 where the shrink film 38 is heated to a temperature of approximately 300° F. (149° C.) by hot air flowing through a side duct 27 extending through a side opening 39 in the tunnel walls 12, 13. Heating the film 38 softens it so that the film 38 shrinks into close proximity with the article 30. The heating zone 40 is bounded by an entrance side 41 near the first conveyor 32 and an exit side 42 spaced downstream of the entrance side 41, near a second conveyor 47. The first conveyor 32 and the second conveyor 47 are both located outside the heating zone 40. Accordingly, articles 30 do not contact a solid surface located inside the heating zone 40. The second conveyor 47 carries articles 30 away from an outlet opening 48 spaced downstream from the inlet opening 31.

As shown in FIG. 2, the first conveyor 32 is spaced from the second conveyor 47 by a distance $d_1$, and packaged articles 30 carried by the conveyors 32, 47 have a length $d_2$ that is greater than $d_1$. If desired, a fixed support (not shown) may be placed in the space 40 below the articles 30 to prevent them from falling downwardly between the conveyors 32, 47.

In an alternative embodiment of the invention not shown in the drawings, the first conveyor 32 is placed at a higher elevation than the second conveyor 47 so that articles 30 fall downwardly through the heating zone 40. In this alternative embodiment, sizes of the articles 30 are less critical than when the conveyors 32, 47 are at approximately the same elevation. Another variation includes a vertically oriented shrink tunnel together with a horizontally mounted first conveyor 32 and second conveyor 47. In this variation articles 30 fall from the first conveyor 32 through the shrink tunnel 11 to the second conveyor 47. This arrangement allows for very short articles 30 to pass through the shrink tunnel 11.

The foregoing description of my invention has been made with reference to some preferred embodiments. Persons skilled in the art understand that numerous changes and modifications can be made without departing from the spirit and scope of the following claims.

What is claimed is:

1. A process for shrink wrapping an article with a polymeric shrink film, comprising:

a.) conveying an article covered by a polymeric shrink film into a shrink tunnel assembly comprising:

1. a shrink tunnel having an interior wall defining a chamber, an inlet opening, an outlet opening spaced from said inlet opening, and a heating zone having an entrance side and an exit side spaced from said entrance side,
2. means for heating to an elevated temperature in the heating zone a polymeric shrink film covering an article,
3. first conveyor means located outside said heating zone for conveying to the entrance side of said heating zone an article covered by a polymeric shrink film, and
4. second conveyor means located outside said heating zone for conveying away from the exit side of said heating zone an article covered by polymeric shrink film, b.) heating said article with the hot air in said heating zone so that said film shrinks closer to said article, said article resisting contact with solid surfaces other than the article within said heating zone while in said heating zone, and c.) conveying said shrink-wrapped article on a conveyor means away from said heating zone.

2. The process of claim 1, wherein said first conveyor means is spaced from said second conveyor means by a distance $d_1$, and said article has a length $d_2$ greater than $d_1$.

3. The process of claim 1, wherein said means for heating is selected from heated air and a radiant heater.

4. The process of claim 1, wherein said means for heating comprises heated air for heating the shrink film to a temperature of about 121–177° C. (250–350° F.).

5. The assembly claim 1, wherein said film comprises at least one polymer selected from the group consisting of polyvinyl chloride, polyethylene, and styrene-butadiene copolymers.

6. The assembly of claim 1, wherein said shrink tunnel further comprises an exterior wall spaced outwardly of said interior wall, and insulating material outside said exterior wall.

7. A shrink tunnel assembly for shrink wrapping an article with a polymeric shrink film, comprising:

a) a shrink tunnel having an interior wall defining a chamber, an inlet opening, an outlet opening spaced downstream from said inlet opening, and a heating zone within said chamber and having an entrance side and an exit side spaced downstream from said entrance side, b) means for heating to an elevated temperature in the heating zone a polymeric shrink film covering an article, c) first conveyor means located outside said heating zone for conveying to the entrance side of said heating zone an article covered by polymeric shrink film, d) second conveyor means located outside said heating zone for conveying away from the exit side of said heating zone an article covered by polymeric shrink film, and wherein said shrink tunnel assembly is dimensioned and configured to resist contact between the polymeric shrink film and any solid surface other than the article in said heating zone, thereby to protect said shrink film from marring and destruction.

8. The assembly of claim 7, wherein said first conveyor means is spaced from said second conveyor means by a distance $d_1$, and said article has a length $d_2$ greater than $d_1$.

9. The assembly of claim 7, wherein said means for heating is selected from heated air and a radiant heater.

10. The assembly of claim 7, wherein said means for heating comprises heated air for heating the shrink film to a temperature of about 121–177° C. (250–350° F.).

11. The assembly of claim 7, wherein said film comprises at least one polymer selected from the group consisting of polyvinyl chloride, polyethylene, and styrene-butadiene copolymers.

12. The assembly of claim 7, wherein said shrink tunnel further comprises an exterior wall spaced outwardly of said interior wall, and insulating material outside said exterior wall.

* * * * *